US005884853A

United States Patent [19]

Higgins

[11] Patent Number: 5,884,853

[45] Date of Patent: Mar. 23, 1999

[54] SELF-CONTAINED MOBILE SYSTEM AND METHOD FOR PROCESSING FRESH CORN

[75] Inventor: David W. Higgins, Lowell, Ark.

[73] Assignee: Razorback Farms, Inc., Springdale, Ark.

[21] Appl. No.: 812,457

[22] Filed: Mar. 5, 1997

[51] Int. Cl.[6] ..... B02C 21/02

[52] U.S. Cl. ..... 241/7; 241/9; 241/23; 241/65; 241/101.76

[58] Field of Search ..... 241/101.75, 101.76, 241/7–12, 65, 23

[56] References Cited

U.S. PATENT DOCUMENTS

| | | | |
|---|---|---|---|
| 2,511,960 | 6/1950 | Andrews | 241/101.75 |
| 3,393,723 | 7/1968 | Blanshine | 241/101.76 |
| 3,396,767 | 8/1968 | Blanshine et al. | 241/101.76 |
| 3,670,972 | 6/1972 | Quinn | 241/101.76 |
| 3,948,451 | 4/1976 | Pecis . | |
| 4,577,805 | 3/1986 | Seymour | 241/101.76 |

OTHER PUBLICATIONS

Letter from David Higgins to Monty L. Ross dated Apr. 11, 1997.

Letter from David Higgins to Monty L. Ross dated Aug. 18, 1997.

*Primary Examiner*—Mark Rosenbaum

*Attorney, Agent, or Firm*—Locke Purnell Rain Harrell, P.C.; Monty L. Ross

[57] ABSTRACT

A mobile system for processing raw ears of corn includes a first mobile processing trailer for receiving raw unhusked ears of corn, holding the ears and disbursing the ears to a first conveyor. The first conveyor transports the ears to a second mobile trailer for further processing. The second mobile trailer includes a husker for removing corn husks and corn silk from the ears, a cutting mechanism for removing kernels from the ears after the husks and silk are removed, and a second conveyor for transporting the corn husks, corn silk, and corn cobs from the second trailer. A third conveyor transports the kernels to a third mobile trailer for further processing. The third mobile trailer includes a cooling tank for chilling the kernels and a conveyor for transporting the kernels to transportation receptacles for transportation to a cannery for further processing.

15 Claims, 4 Drawing Sheets

SELF-CONTAINED MOBILE SYSTEM AND METHOD FOR PROCESSING FRESH CORN

TECHNICAL FIELD

The present invention relates generally to a system and method for processing fresh corn and in particular to a self-contained mobile processing plant for processing fresh corn in proximity to the field in which it is grown.

BACKGROUND OF THE INVENTION

In the prior art, fresh ears of corn have been typically processed by harvesting the corn in the field with standard prior art corn strippers and then transporting it to central canneries where the fresh corn kernels are cut from the cob and the kernels and juice are frozen or canned. The desired portion of the fresh corn, the kernels, comprise approximately 25% to 30% by weight of the total fresh corn harvested in the field. The shucks and cobs, approximately 70% by weight, are waste. Conventional canneries may be many miles from the field in which the corn is grown. Therefore, approximately 70% of the hauling charges incurred in hauling the unprocessed raw corn to the cannery are attributable to cobs and shucks that will ultimately be waste. Moreover, additional hauling charges will be incurred for transporting the waste away from the cannery.

Additionally, there are numerous canneries located in agricultural areas that are capable of freezing and/or canning fresh produce; however, there are substantially fewer canneries that contain equipment that is capable of husking and cutting the kernel corn from the cob. Transportation expense and spoilage time restrict the potential growing area for fresh green corn to geographic areas in general proximity to canneries with husking and cutting capability.

In order to reduce the transportation expense, a prior art mobile processor with husking and cutting was developed by Byron. The Byron equipment is attached to the stripper and cuts the kernel corn off the cob in the field as the ears of corn are stripped from the stalk. The machine is very expensive and has no chilling capabilities. The removed kernels and juice are transferred from the Byron processor to open-top stainless steel trailers (also expensive) at ambient temperatures. Depending on ambient temperatures the corn kernels must reach a cannery for further processing within 4 to 5 hours or the corn will spoil.

SUMMARY OF THE INVENTION

The present invention comprises a self-contained mobile fresh corn processing system that may be transported in proximity to the field in which the corn is grown. In the present invention, raw ears of unhusked corn are received into a first processing trailer that holds the ears and disburses them onto a first conveyor. The ears are transported via the first conveyor to a second trailer for further processing. In the second trailer corn husks and silk are removed from the ears. Corn kernels are then cut from the ears and transported via a conveyor to a third trailer for further processing. The corn husks, corn silk and corn cobs are removed from the second trailer via a conveyor to a waste receptacle. The third mobile trailer includes a cooling tank for chilling the kernels and a conveyor for transporting the chilled kernels from the cooling tank to transportation receptacles for transportation to a cannery.

The present system presents advantages over conventional systems because the geographic growing area for fresh corn is substantially expanded. In the present invention, the husking and cutting function is accomplished in proximity to the field in which the corn is grown; therefore, conventional canneries may be used for final processing of the output product from the present invention. As noted in the background section of this application, there are numerous canning facilities located in agricultural areas but only a limited number of those include the capability for husking and cutting kernels. By expanding the number of canneries capable of processing the corn, the area for growing fresh corn is increased.

Additionally, versatility and cost competitiveness are provided by the availability of conventional canneries for the final processing of the fresh corn.

The present invention presents advantages over conventional prior art systems to both growers and processors in that hauling costs are reduced because the cobs and husks are not transported to the cannery, but are instead separated as waste in proximity to the field in which the corn is grown. The cobs and husks may be returned to the field as fertilizer or stored by farmers as silage.

The present invention presents advantages to both growers and processors over the Byron machine. In the present invention, the output product is chilled and packaged in large plastic bulk containers. Due to refrigeration of the output product of the present invention, the distance from the cannery to the grower may be substantially increased. The length of the harvesting season and geographic growing area may be extended in order to handle corn grown longer distances from the cannery.

Additionally, the present invention presents advantages over both conventional systems and the Byron machine in that quality of the end product is enhanced. Freshness is maximized by processing in proximity to the field and spoilage is minimized due to refrigeration of the output product immediately upon processing. Furthermore, promptly removing the kernels from the cob after harvesting and promptly cooling thereafter reduces the starch content of the end product.

The present invention is superior to the Byron machine in that the present invention has substantially larger throughput capability. In the Byron machine, the corn processor is attached to one stripper. Therefore, the maximum throughput of the Byron machine may be limited by the rate at which one stripper can harvest the ears of corn. However, in the present invention, multiple strippers may be concurrently harvesting corn and delivering it to the input end of the processing system. Due to the higher throughput, the present invention has a much lower cost per unit processed over the Byron machine and yet has the advantages of increased freshness and reduced spoilage as discussed above.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
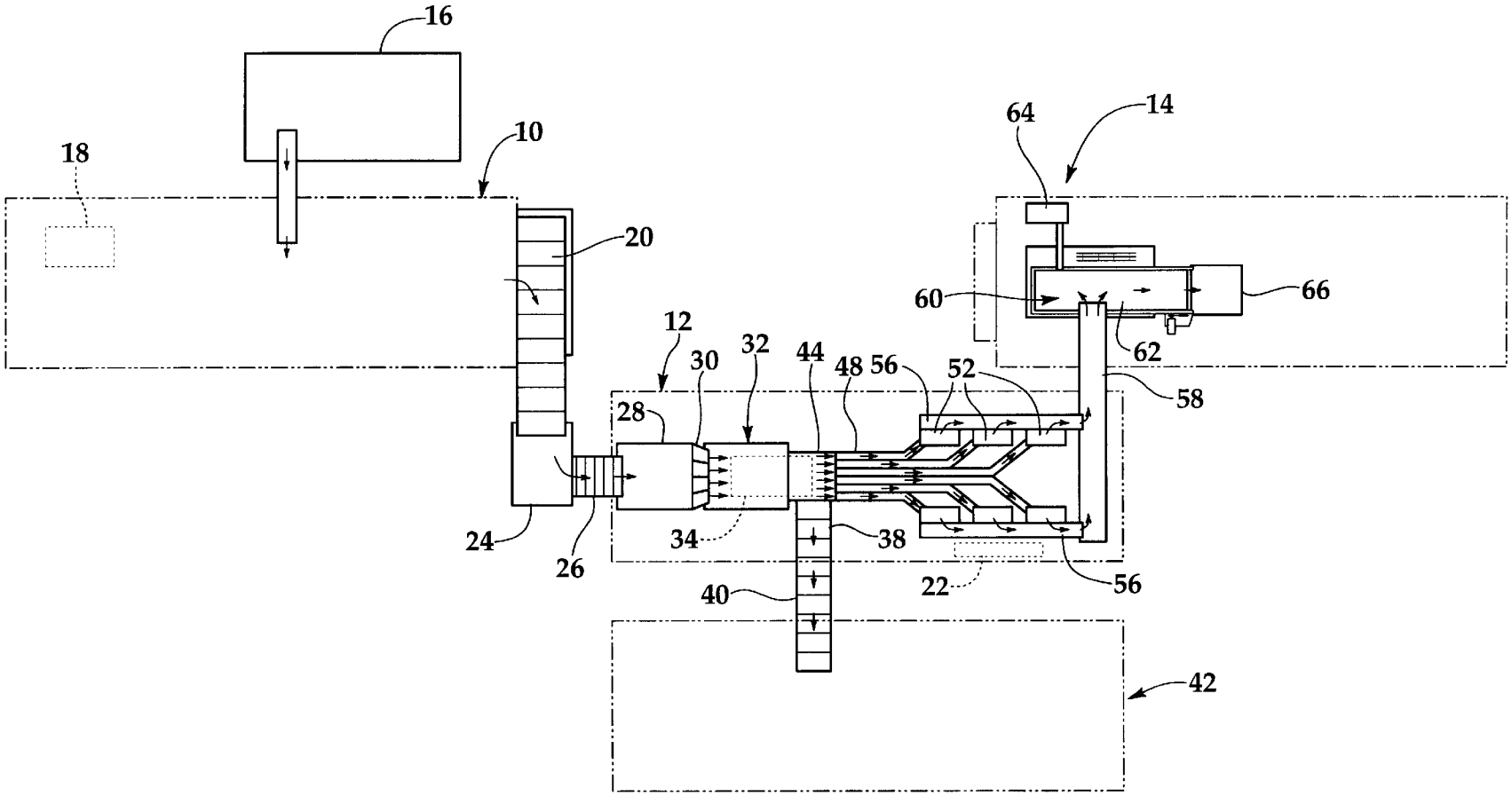
FIG. 1 is a plan view of the self-contained mobile corn processing system of the present invention.

Reference is now made to the Drawings wherein like reference characters denote like or similar parts throughout the four Figures. The present invention comprises a self-contained mobile fresh corn processing system that may be transported in proximity to the field in which the corn is grown. The system includes three self-contained movable semi-trailers 10, 12 and 14, such as are typically manufactured and conventionally used to transport goods on the highways, wherein corn processing equipment is contained inside or thereon the semi-trailers. The corn processing equipment is conventional equipment similar to that located in fixed canneries; however, the equipment has been modified so as to be self-contained in the mobile trailers.

A first trailer 10 receives fresh unhusked corn from a harvester 16. The harvester 16 may be any conventional corn harvester that strips the ears of unhusked corn from the stalk and discards the stalk. Corn may be fed into the first trailer 10 directly from the harvester 16 by elevating the harvester's dump box or alternatively from a transportation buggy filled by the harvester 16 in the field. The trailer 10 functions as a holding bin with a vibrating floor (commonly known in the trade as a walking floor). A self-contained power unit 18 is located below the bed of the trailer 10. A 35 horsepower motor powers a bi-directional hydraulic pump which operates the walking floor. The walking floor feeds the unhusked corn to a cleated first conveyor 20 that transports the corn to a hopper 24. The hopper 24 dispenses corn at a predetermined rate onto an inclined belted conveyor 26. Corn is delivered by conveyor 26 through an opening in the second trailer 12 end wall to a shaker/feeder table 28.

Figure 2:
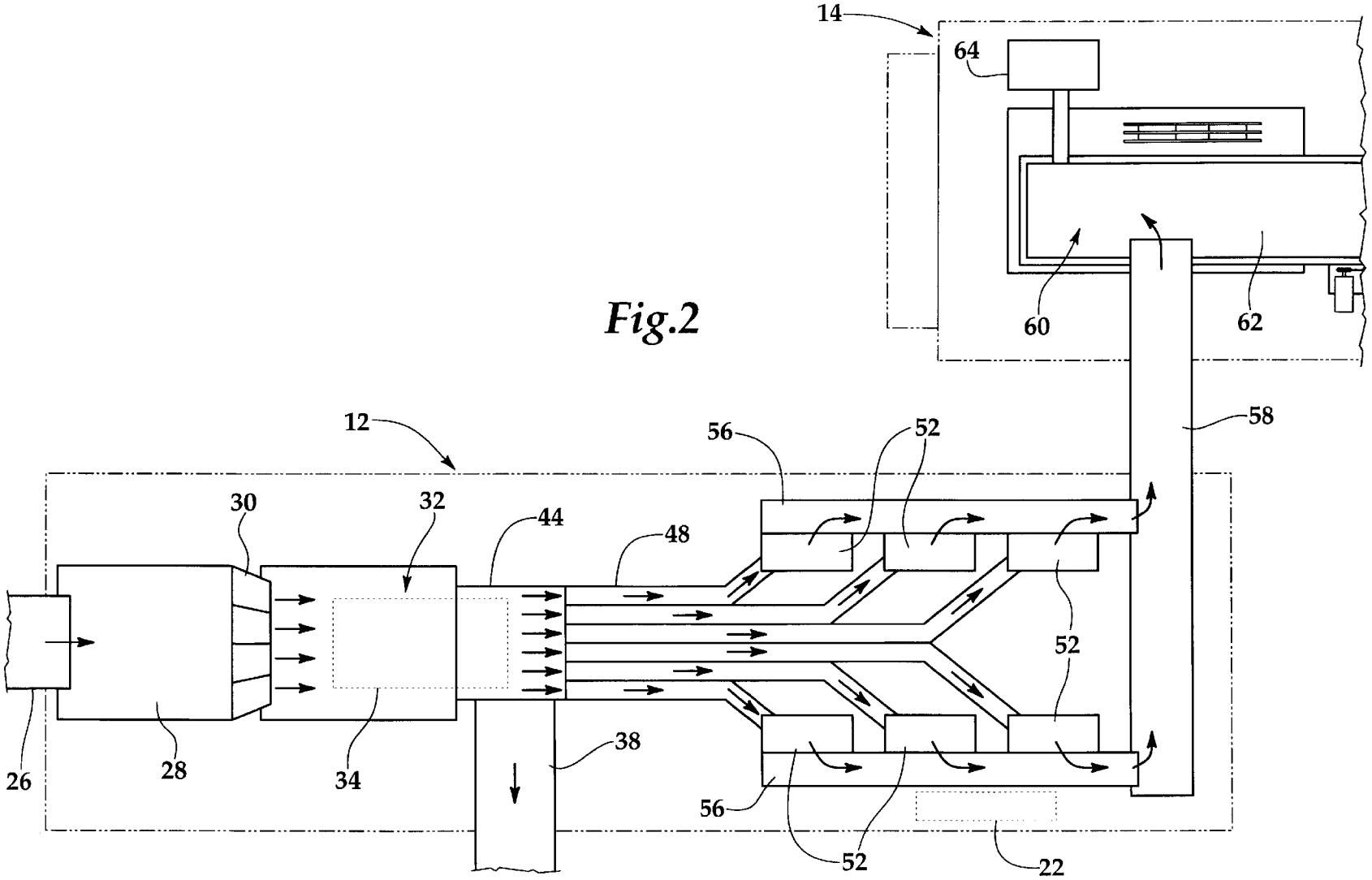
FIG. 2 is an enlarged portion of the plan view of FIG. 1 illustrating the husking, cutting and chilling equipment of the present invention.
Figure 3:
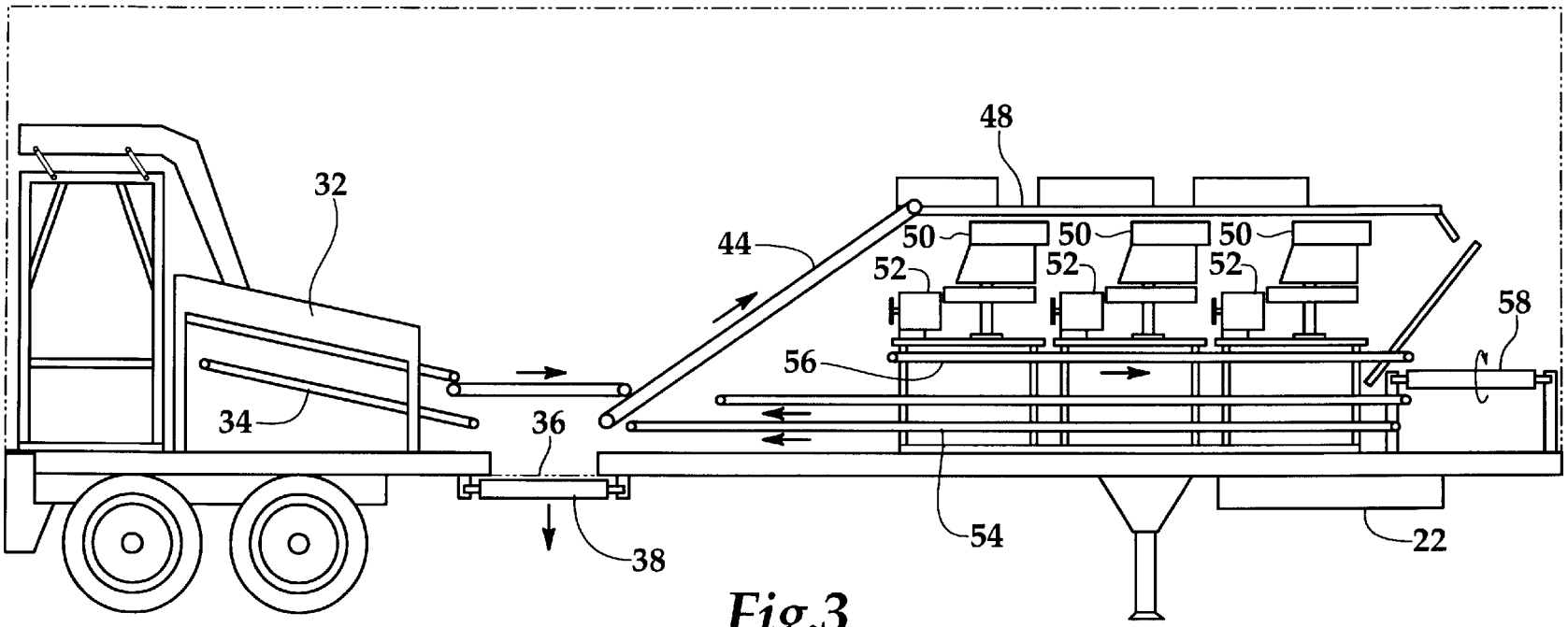
FIG. 3 is an elevation view of a portion of FIG. 2 illustrating the husking and cutting equipment of the present invention.

Referring now to FIG. 2, an enlarged portion of FIG. 1, wherein the details of the second trailer 12 are illustrated more clearly. The shaker/feeder table 28, located inside the trailer 12, distributes the ears of corn into a single layer and randomly directs the ears of corn to a husking bed 32 wherein the corn shucks and corn silks are removed by counter-rotating rubber grip rollers. The table 28, a chute 30 and the husking bed 32 are conventional equipment of the type manufactured by CCM, Hughes, or FMC. As can be seen more clearly in FIG. 3, the husks are caught by a husker trash belt 34, positioned below the husking bed 32. The corn husks are transported by the trash belt 34 to an opening 36 in the bed of the trailer 12. Referring to FIGS. 2 and 3, positioned below the opening 36, is a cross belt trash conveyor 38. Shucks and waste cobs are transported by the conveyor 38 and an inclined cleated conveyor 40 to a trash trailer 42 for disposal. The waste cobs and shucks may be returned to the fields and plowed under as fertilizer or transported to storage and used for silage.

The husked ears of corn are gravity-fed onto an inspection belt 44 wherein the ears of corn are visually inspected for ears that are unsatisfactory for the next step in processing. Unsatisfactory ears include those not fully developed or short ears. Such unsatisfactory ears are manually removed and discarded. Partially de-shucked or de-silked ears are recycled through the husker. Satisfactory ears of corn are transported by a top feed conveyor 48 to an orienter 50 that divides and orients the shucked ears of corn in feed chutes with the point end forward. The oriented corn is carried by an intake chain (not shown) to cutter mechanism 52 wherein a plurality of mechanical knives (not shown) follow the contours of the cob and remove the kernels from the cob. A white PVC (food grade) kernel conveyor belt 56 transports the cut kernels out an opening in the sidewall of the second trailer 12 into the third trailer 14 through an opening in the third trailer 14 sidewall. Cobs from the cutter 52 are conveyed by a cob trash conveyor 54 to the opening 36 in the bed of the second trailer 12 and then via conveyors 38 and 40 to trash trailer 42. Referring to FIGS. 1–3, conveyors 58 and 62 are powered by a cutting trailer power unit 22, which is preferably a 65 H.P. diesel powered-unit with a hydraulic pump.

Referring now to the third trailer 14, shown in FIGS. 1 and 2, corn kernels are delivered by conveyor 58 to the cooling tank 60. The cooling tank 60 chills the corn from ambient temperature to approximately 38° to 40° F. by circulating water chilled from 28° to 30° F. through the tank. The cooling water is inspected and changed as needed for maintenance of sanitary conditions. Generally, the cooling water is changed at least daily. The cooling water is chilled by a conventional chiller comprising a heat exchanger and compressor/condenser 64 located underneath the bed of the third trailer 14. Approximately 12 tons of cooling are required to cool a throughput of 4000 pounds of kernels per hour from 100° to 38° F. Alternatively, the cooling tank 60 may include jacketed conventional cooling coils containing glycol or other refrigerant located in the tank 60 and a heat exchanger and compressor/condenser.

A cooled kernel conveyor 56 fabricated from stainless steel mesh transports the chilled kernels from the cooling tank 60 to a transportation tote 66. Transportation totes 66 may be any sanitary containers capable of bulk transportation of approximately 1300 to 1400pounds of the kernel corn and juice. Typical containers may be stackable polymeric or stainless containers with suitable sealing lids or corrugated crates with plastic liners. The transportation totes 66 are loaded via hand trucks onto conventional tractor trailers and delivered to a cannery for further processing. If a cannery is not nearby, refrigerated tractor trailers may be used to transport the transportation totes 66 containing the kernel corn to more distant canneries. The refrigerated trailers transport the kernel corn at about 28° to 30° F. As noted in the Background and Summary of the Invention sections of this application, chilling of the corn and refrigerated transportation provide distinct advantages over prior art systems for processing kernel corn.

Figure 4:
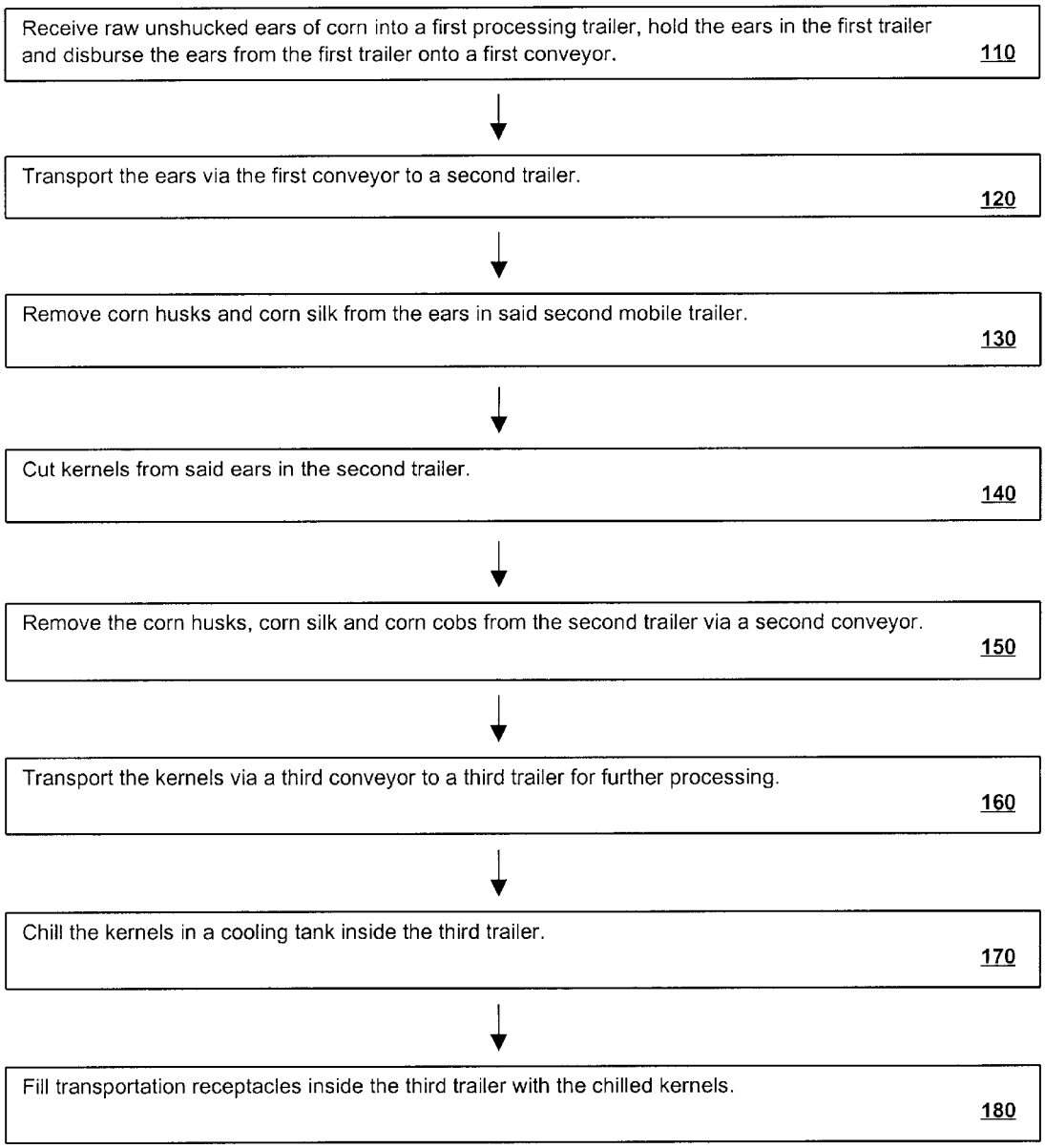
FIG. 4 is a schematic block diagram illustrating the steps in the practice of the present invention.

Referring now to FIG. 4, a block diagram illustrates the major method steps for practice of the present invention as heretofore described in the above detailed description. As indicated as block 110, raw unshucked ears of corn are received into the first processing trailer where they are held and then disbursed onto a first conveyor. As noted in block 120, the ears are transported via the first conveyor to a second trailer. As detailed in block 130, the corn husks and corn silks are removed from the ears in the second trailer. Next as indicated in block 140 the kernels are cut from the ears. Concurrently with steps 130 and 140, as indicated in block 150, corn husks, corn silks and corn cobs are removed from the second trailer. Next, as noted in block 160, the kernels are transported via a third conveyer to a third trailer for further processing. In step 170, the kernels are chilled in a cooling tank inside the third trailer. Finally in step 180, transportation receptacles are filled with the chilled kernels and dispatched from the third trailer to canneries for further processing.

Although preferred embodiments of the present invention have been illustrated in the accompanying Drawings and described in the foregoing Detailed Description, it will be understood that the invention is not limited to the embodiments disclosed but is capable of numerous rearrangements, modifications, and substitutions of parts and elements without departing from the spirit of the invention. Such modifications may include, but are not limited to, the use of two or more husking and cutting trailers to increase the inlet kernel corn to the cooling trailer. Alternatively, if the harvesting area is located very near a cannery, the raw kernel corn may be processed as taught herein and transported in bulk containers without the chilling steps.

I claim:

1. A method for processing fresh corn in a mobile processing system disposed at or near a harvest site by receiving raw unhusked ears of corn into a mobile processing apparatus;

mechanically removing corn husks and silk from said ears within the mobile processing apparatus;

mechanically cutting kernels from a cob portion of said ears within the mobile processing apparatus after the husks and silk are removed;

discharging the corn husks, corn silks, and corn cobs from the mobile processing apparatus;

chilling said kernels within the mobile processing apparatus and filling receptacles with said chilled kernels to a cannery for further processing.

2. A method for processing fresh corn in a mobile processing system disposed at or near a harvest site by receiving raw unhusked ears of fresh corn into a holding bin disposed in a mobile processing apparatus, disbursing said ears from said holding bin;

mechanically removing corn husks and silk from said ears within the mobile processing apparatus;

mechanically cutting kernels from a cob portion of said ears after the husks and silk are removed;

discharging the corn husks, corn silks, and corn cobs from the mobile processing apparatus;

chilling said kernels in a cooling tank within the mobile processing apparatus; and filling receptacles with said chilled kernels.

3. A method for processing fresh corn in a mobile processing system disposed at or near a harvest site by receiving raw unhusked ears of corn into a first processing trailer, holding said ears in the first trailer and disbursing said ears from said first trailer onto a first conveyor;

transporting said ears via the first conveyor to a second trailer for further processing;

wherein processing in the second trailer includes mechanically removing corn husks and silk from said ears, mechanically cutting kernels from a cob portion of said ears after the husks and silk are removed, and transporting the corn husks, corn silks, and corn cobs via a second conveyor from the second trailer;

transporting said kernels via a third conveyor to a third trailer for further processing; and wherein processing in the third trailer includes chilling said kernels in a cooling tank, and filling transportation receptacles with said chilled kernels for transportation to another processing facility.

4. The method of processing fresh corn of claim 2 wherein the kernels are chilled in the cooling tank from ambient temperature to a temperature below about 40° F.

5. The method of processing fresh corn of claim 2 wherein said transportation receptacles are filled with from about 1300 to about 1400 pounds of said chilled kernels.

6. The method of processing fresh corn of claim 3 wherein two or more first trailers receive and hold raw ears of corn and said ears of corn are transported via one or more conveyors to said second trailer for processing.

7. The method for processing fresh corn of claim 3 wherein the first trailer receives raw ears directly from corn strippers harvesting corn in fields proximate to said mobile system.

8. A method for processing fresh corn in a trailerable processing apparatus by receiving unhusked ears of fresh corn into the apparatus;

mechanically removing corn husks and silk from said ears within the apparatus;

orienting the ears with the point end forward;

mechanically cutting kernels from said ears chilling the kernels; and filling receptacles with said kernels for transportation to a fixed processing facility.

9. A mobile system for processing raw ears of fresh corn comprising trailerable apparatus for receiving raw unhusked ears of fresh corn, a disbursing mechanism for transporting said ears, a cutting mechanism for removing kernels from said ears after the husks and silk are removed, a cooling device for chilling said kernels and at least one receptacle for holding the chilled kernels.

10. A mobile system for processing raw ears of fresh corn comprising:

portable apparatus for receiving raw unhusked ears of corn, a husking mechanism for removing corn husks and corn silk from said ears;

a cutting mechanism for removing kernels from said ears after the husks and silk are removed, a cooling tank for chilling said kernels, and at least one receptacle for holding the chilled kernels during transportation to a cannery for further processing.

11. A mobile system for processing raw ears of fresh corn comprising:

a corn holding bin;

a conveyor disposed between the holding bin and a husking mechanism, the husking mechanism adapted to remove corn husks and corn silk from said ears;

a mechanism for cutting kernels from ears received from the husking mechanism;

a cooling tank for chilling said kernels, and at least one receptacle for holding the chilled kernels.

12. The mobile system of claim 11 further comprising a self-contained power source.

13. The mobile system of claim 11 further including a shaker/feeder table for distributing the unhusked ears of corn into a single layer and randomly directing said ears to the husking mechanism.

14. The mobile system of claim 11 further including an inspection conveyor for use in visually inspecting the ears of corn after the corn shucks and corn silks have been removed.

15. The mobile system of claim 11 further including a heat exchanger and condenser/compressor for cooling a fluid that is circulated through the cooling tank.

* * * * *